US006422341B1

(12) United States Patent
Engdahl

(10) Patent No.: US 6,422,341 B1
(45) Date of Patent: Jul. 23, 2002

(54) LIFT-UP RAIL EXTENSIONS

(75) Inventor: Jack T. Engdahl, Montara, CA (US)

(73) Assignee: Royalite Manufacturing, Inc., San Carlos, CA (US)

( * ) Notice: Subject to any disclaimer, the term of this patent is extended or adjusted under 35 U.S.C. 154(b) by 0 days.

(21) Appl. No.: 09/672,096

(22) Filed: Sep. 29, 2000

Related U.S. Application Data

(60) Provisional application No. 60/157,208, filed on Sep. 30, 1999.

(51) Int. Cl.[7] ..... E06C 7/18

(52) U.S. Cl. ..... 182/106; 182/103; 182/204

(58) Field of Search ..... 182/8, 93, 100, 182/103, 106, 111, 172, 178, 127, 204, 209, 213, 211, 228; 248/210, 238, 188.8

(56) References Cited

U.S. PATENT DOCUMENTS

| | | | | | |
|---|---|---|---|---|---|
| 475,935 | A | * | 5/1892 | Crews | 182/106 X |
| 3,139,154 | A | * | 6/1964 | Ewald | 182/106 |
| 3,447,631 | A | * | 6/1969 | Smith | 182/106 X |
| 3,455,414 | A | * | 7/1969 | Higgins | 182/106 |
| 4,079,965 | A | * | 3/1978 | Moughty et al. | 285/7 |
| 4,183,423 | A | * | 1/1980 | Lewis | 182/103 |
| 4,226,302 | A | * | 10/1980 | Roche | 182/178 |
| 4,247,216 | A | * | 1/1981 | Pansini | 403/109 |
| 4,473,262 | A | * | 9/1984 | Staye | 312/333 |
| 4,546,855 | A | | 10/1985 | Lyons | |
| 4,574,937 | A | * | 3/1986 | Anderson et al. | 198/321 |
| 4,607,726 | A | | 8/1986 | Davis et al. | |
| 4,729,453 | A | | 3/1988 | Lyons, Sr. | |
| 4,798,262 | A | * | 1/1989 | Margolies | 182/106 |
| 4,844,199 | A | * | 7/1989 | Nimz | 182/106 |
| 4,974,699 | A | | 12/1990 | Boring | |
| 5,012,892 | A | | 5/1991 | Kelly | |
| 5,033,582 | A | * | 7/1991 | Hoben | 182/106 X |
| 5,035,299 | A | * | 7/1991 | Eisenberg | 182/212 |
| 5,099,952 | A | | 3/1992 | Farrell | |
| 5,117,943 | A | * | 6/1992 | Schmitt et al. | 182/213 |
| 5,156,234 | A | | 10/1992 | McCallum et al. | |
| 5,429,207 | A | * | 7/1995 | Frank et al. | 182/209 |
| 5,460,410 | A | * | 10/1995 | Petzi et al. | 280/801.2 |
| 5,715,908 | A | | 2/1998 | Sager | |
| 5,779,386 | A | * | 7/1998 | Eichhorn | 403/329 |
| 6,095,284 | A | * | 8/2000 | Smith | 182/103 |

OTHER PUBLICATIONS

Brochure for Royalite Manufacturing, Inc. "Sure Step Aluminum Fixed Access Ladder." 05515/Roy, BuyLine 7883.

* cited by examiner

*Primary Examiner*—Bruce A. Lev
(74) *Attorney, Agent, or Firm*—Burns, Doane, Swecker & Mathis, LLP

(57) ABSTRACT

A lift up rail extension assembly is to be mounted onto an existing ladder which has a first rail and an opposite second rail. The first and second rails are connected by at least one step. The lift up rail extension assembly includes a first rail extension which is slidably mounted to the first rail of the existing ladder, a second rail extension which is slidably mounted to the second rail of the existing ladder, and first and second devices for latching which are pivotally mounted to the first and second rail extensions. The first and second devices for latching are movable between an unlatched position and a latched position. In addition, the first and second devices for latching each have a weighted portion so that when the respective rail extension is extended in a first direction, the weighted portion moves the devices for latching to the latched position.

32 Claims, 17 Drawing Sheets

LIFT-UP RAIL EXTENSIONS

The present application is related to and claims priority under 35 U.S.C. §119 to U.S. application Ser. No. 60/157,208, filed Sep. 30, 1999, the entire content of which is incorporated by reference herein.

BACKGROUND OF THE INVENTION

1. Field of the Invention

The invention relates to a ladder assembly, and more particularly, the invention relates to a ladder with rail extensions.

2. Brief Description of the Related Art

A number of different ladder safety devices are known which can be secured to an existing ladder to increase safety when descending from or climbing onto a roof, wall, or other structure. Such known ladder safety devices are typically kept in a retracted state and later extended to provide a rail which the user can grasp to improve his or her balance while using the ladder.

Nevertheless, known ladder safety devices require extensive hand manipulation to actuate and secure the safety device. The hand manipulation is difficult if the user needs his or her hands for other tasks, such as opening a hatch on the roof. Additionally, many known devices do not provide any means for locating a top step of the ladder when the user dismounts from the roof, wall, or other structure, thereby forcing the user to blindly search for the top step while descending from the roof, wall, or other structure.

Accordingly, it would be desirable to provide a ladder safety device that is easily actuated and secured in position with respect to the ladder, whereby the device assists the user when descending from or climbing onto a structure.

SUMMARY OF THE INVENTION

One embodiment of the present invention is directed to a lift up rail extension assembly which is to be mounted onto an existing ladder. The existing ladder has a first rail and an opposite second rail which are connected by at least one step. The lift up rail extension assembly includes a first rail extension which is mountable to the first rail of the existing ladder, a second rail extension which is mountable to the second rail of the existing ladder, and first and second means for latching the first and second rail extensions to the first and second rails, respectively. The first and second means are pivotally mounted to the first and second rail extensions and can each move between an unlatched position and a latched position. In addition, the first and second means for latching each have a weighted portion so that when a respective rail extension is extended in a first direction, the weighted portion moves the means for latching to the latched position.

In accordance with one aspect of the present invention, a ladder assembly includes a first and a second elongated hollow member, at least one step member horizontally mounted between the pair of elongated hollow members, a first rail extension slidably mounted within the first elongated hollow member, a second rail extension slidably mounted within the second elongated hollow member, and a first and a second means for latching. The first means for latching is pivotally mounted to the first rail extension and can move between an unlatched position and a latched position. The second means for latching is pivotally mounted to the second rail extension and can move between an unlatched position and a latched position. The first and second means for latching each have a weighted portion so that when the respective rail extension is extended in a direction away from the ladder, the weighted portion moves the means for latching to the latched position.

In accordance with another embodiment of the present invention, the ladder assembly can be used in cooperation with a tool lift assembly, which includes a lift platform coupled with an elongated hollow member, a cable and pulley means, and a winch secured to the elongated hollow member. The winch has means for moving the lift platform through the cable and pulley means along the elongated hollow member.

In accordance with a further aspect of the invention, a method of providing assistance in descending from or climbing onto a structure, such as a roof, is disclosed. In the method, a first rail extension is extended in a sliding manner and in a first direction from a first rail of the ladder. A second rail extension is extended in a sliding manner and in a first direction from a second rail of the ladder. Once the first and second rails have traveled a predetermined distance, first and second weighted portions, which are respectively pivotally mounted to each of the first and second rail extensions, are allowed to move to a latched position. The first and second rail extensions provide locating means for locating a top step of the existing ladder.

One object of the present invention is to enable a user to easily manipulate the rail extensions from a stored position to a locked extended position with one hand.

Another object of the present invention is to enable a user to easily locate the top step of a ladder when the user intends to descend from a roof, wall or other structure.

BRIEF DESCRIPTION OF THE DRAWINGS

The invention will now be described in greater detail with reference to the preferred embodiments illustrated in the accompanying drawings, in which like elements bear like reference numerals, and wherein.

DETAILED DESCRIPTION OF THE PREFERRED EMBODIMENTS

Figure 1:
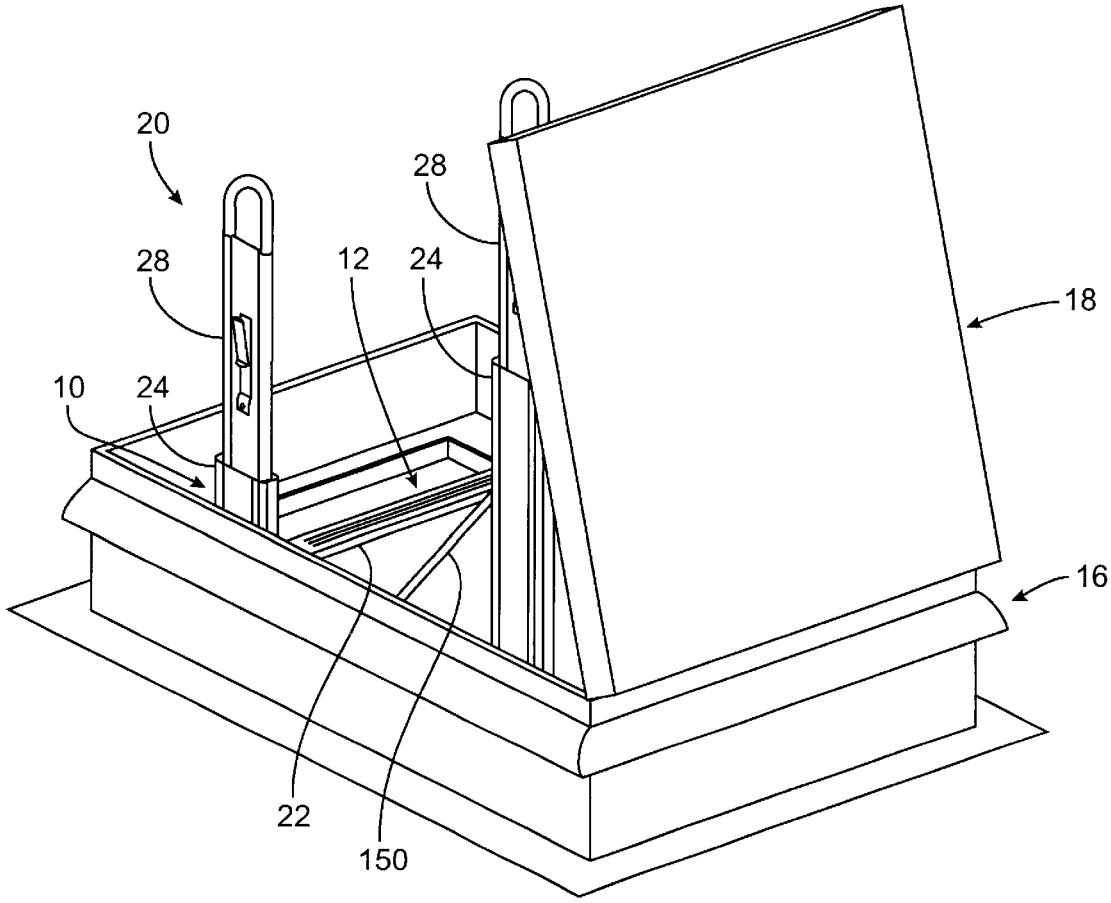
FIG. 1 is a perspective view of lift up rail extensions extending through a roof hatch in accordance with the present invention.
Figure 2:
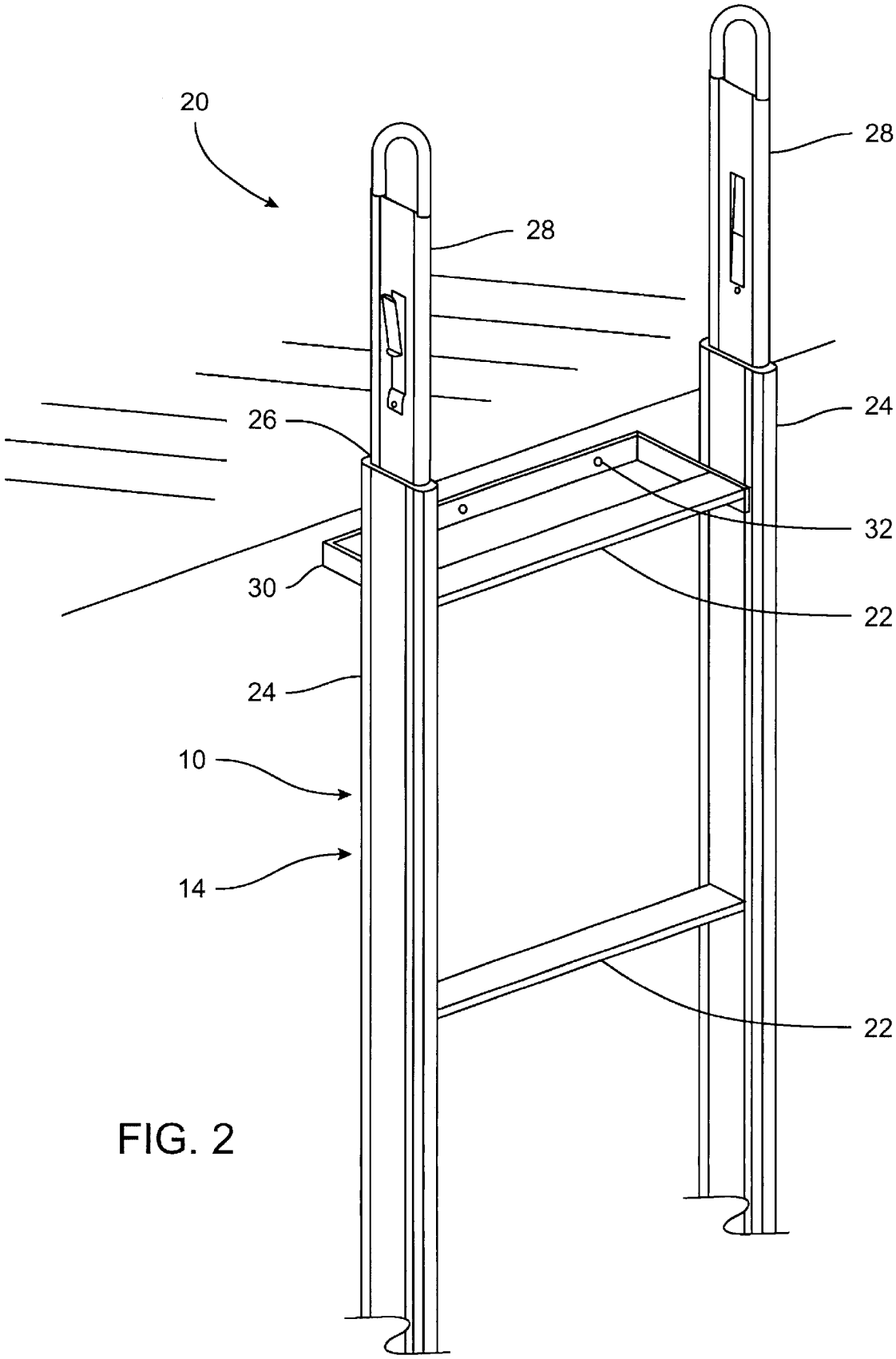
FIG. 2 is a perspective view of a lift up rail extension ladder mounted to a wall.

As shown in FIGS. 1 and 2, the lift up rail extension ladder 20 of the present invention can be mounted onto the rails of a ladder 10 located inside a hatch structure or on a wall structure. The lift up rail extension ladder 20 assists a user in climbing onto or descending from a roof, wall or other structure.

FIG. 1 shows a roof hatch ladder 12 which has a pair of rail extensions 28. The roof hatch ladder 12 includes a frame 16 and a hatch or security door 18. A pair of hinges (not shown) connected to the hatch 18 allow the hatch to rotate to an open position. A rod 150 connected to the hatch 18 and the frame 16 can act as a truss member, and thereby secure the hatch in the opened position. An adjustable slide (not shown) may be used in place of the rod. The rail extensions 28 extend above a top step of the ladder. In an extended position, the rail extensions 28 can also prevent the hatch 18 from closing. The rail extensions 28 help the user to ascend to and descend from the roof or other structure by providing a rail that the user may hold onto while climbing onto the roof and providing a rail to hold onto while stepping from the roof to the top step of the ladder 12.

FIG. 2 shows a lift up rail extension ladder 20 used in a slightly different manner, in which a ladder 14 is mounted to a wall, without the use of a roof hatch. The lift up rail extension ladder 20 includes a step member 22 attached to a pair of elongated members 24. A bracket member 30 is attached to the lift up rail extension ladder 20 and allows the ladder to be mounted by securing means 32 to the wall. The securing means 32 may include any suitable means to secure the ladder to the wall, but in the preferred embodiment, the securing means includes a fastening bolt fitted into a corresponding hole in the wall.

Figure 3:
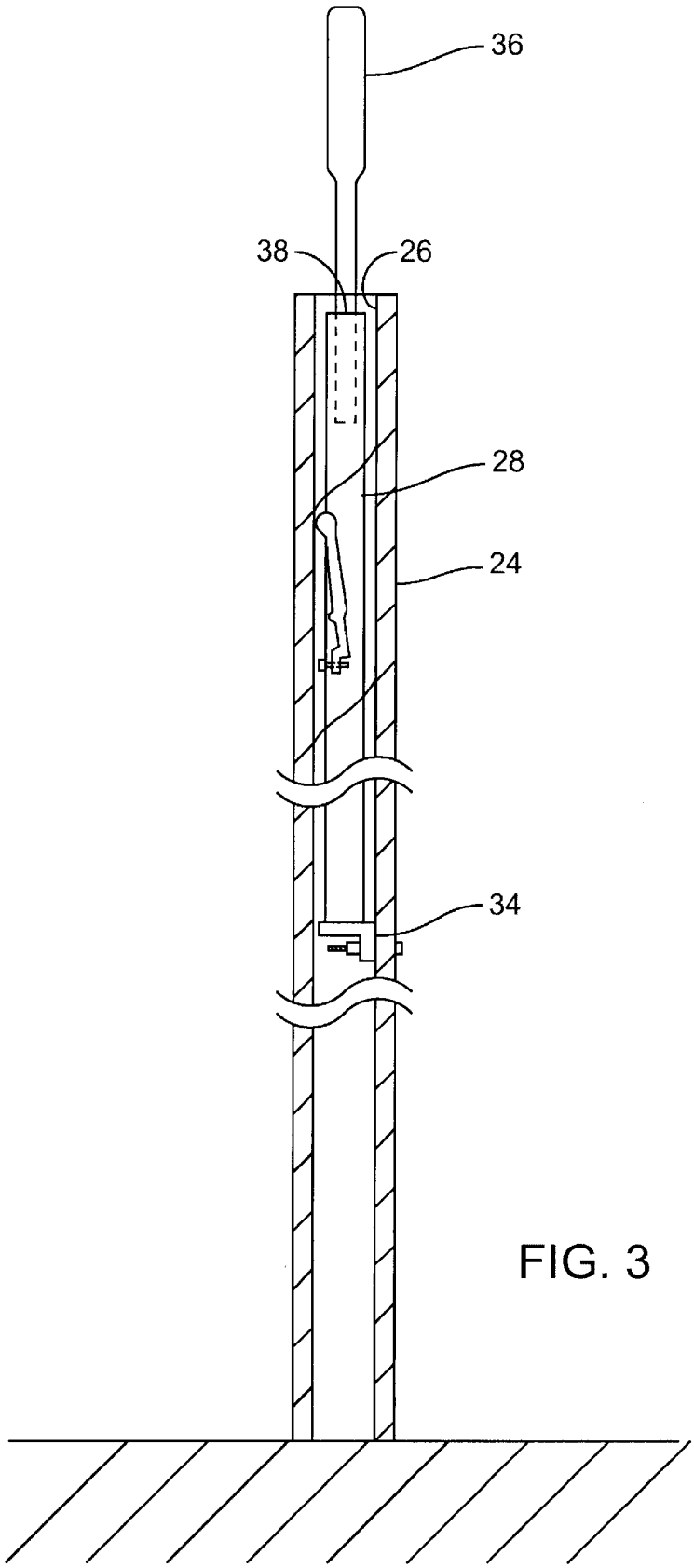
FIG. 3 is a front partial cross sectional side view of a rail extension.

As shown in FIG. 3, each elongated member 24 has a passage 26, which is provided to allow a rail extension 28 to be received within the elongated member. The rail extension 28 is slidably received in the passage 26 of the elongated member 24. A stopping means 34 mounted to the elongated member 24 supports the rail extension 28 in a first retracted position, as shown. The stopping means 34 prevents further insertion of the rail extension 28 into the elongated member 24 beyond a predetermined distance. The stopping means 34 may include any suitable means including, but not limited to, an L-shaped bracket, a collar, or a projecting tab. A handle 36 positioned at an end 38 of the rail extension 28 is for assisting a user in moving the rail extension 28. The handle 36 extends about 3 to 6 inches, preferably about 4 inches, above the end 38 of the rail extension 28. The handle 36 can be made in any suitable manner and can be attached to the rail extension 28 by any suitable means. For example, the handle 36 may be tubing material that is press fit into the rail extensions. The interference or press fit is approximately 0.001 inches to 0.005 inches. The handle 36 may be anodized with a bright color, such as red, to allow the user to easily locate the handle when in use.

Figure 4:
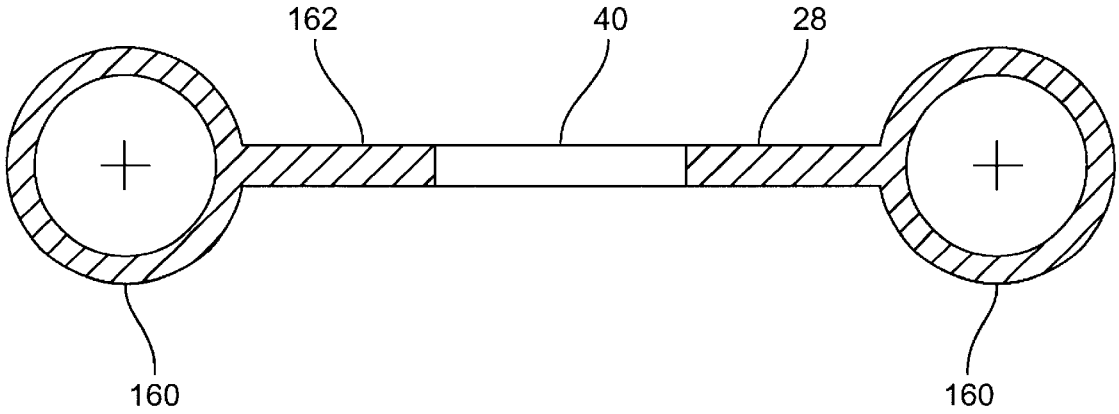
FIG. 4 is a top cross sectional view of a rail extension.

In a preferred embodiment, the rail extension 28 is an extruded aluminum piece and has an anodized outer surface. The rail extension 28 includes two cylindrical members 160 connected by a web 162, as illustrated in FIG. 4. The web 162 defines an opening 40 which extends transversely through the rail extension 28. The length of the rail extension 28 is about 24 to 72 inches, preferably about 58 inches.

Figure 5:
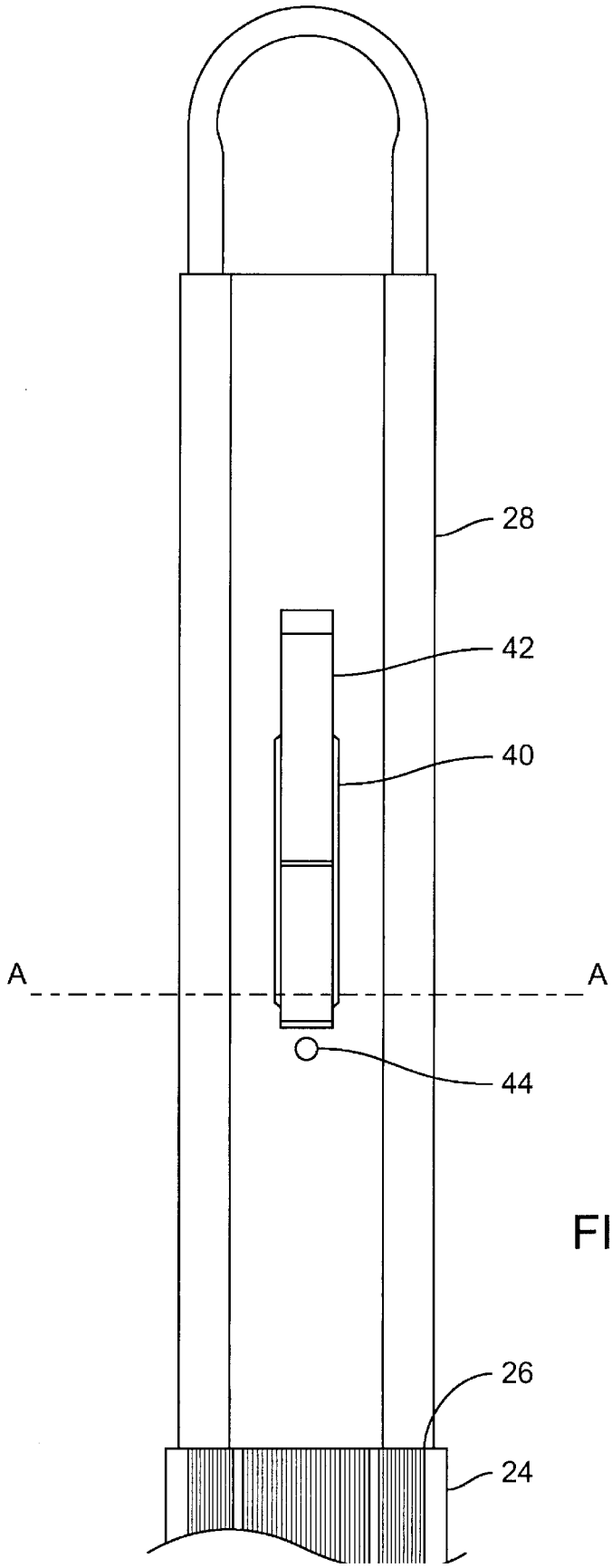
FIG. 5 is a side view of a rail extension.

As shown in FIG. 5, a latch mechanism 42 is pivotally mounted to the rail extension 28 by a connecting means 44. The connecting means 44 couples the latch mechanism 42 to the rail extension 28 and allows the latch mechanism to pivot about a line A—A parallel to an axial centerline. The connecting means 44 may include any suitable fastener including, but not limited to, a rivet, a bolt, a hook, a hinge, or the like, so long as the latch mechanism can pivot about the line A—A. When the latch mechanism 42 is in an unlatched position, the opening 40 receives a portion of the latch mechanism 42. By receiving a portion of the latch mechanism, the opening 40 allows the rail extension 28 to be mounted within the elongated member 24 in a retracted position. In addition, the latch mechanism 42 may be anodized with a bright color, such as red, to allow the user to easily identify the latch mechanism when in use.

Although the latch mechanism 42 has been shown to be mounted within the opening 40 in the elongated member 24, it is to be understood that the elongated member 24 does not require an opening 40. Rather, the latch mechanism 42 may be mounted on a side of the elongated member 24, such that, in the unlatched position, the latch mechanism is positioned between the elongated member and a side wall of the rail extension 28.

In a preferred embodiment, the latch mechanism 42 includes a member (not shown) on a lower portion thereof which restricts the movement of an upper portion of the latch mechanism from rotating away from the rail extension 28 beyond a predetermined distance.

Figure 5A:
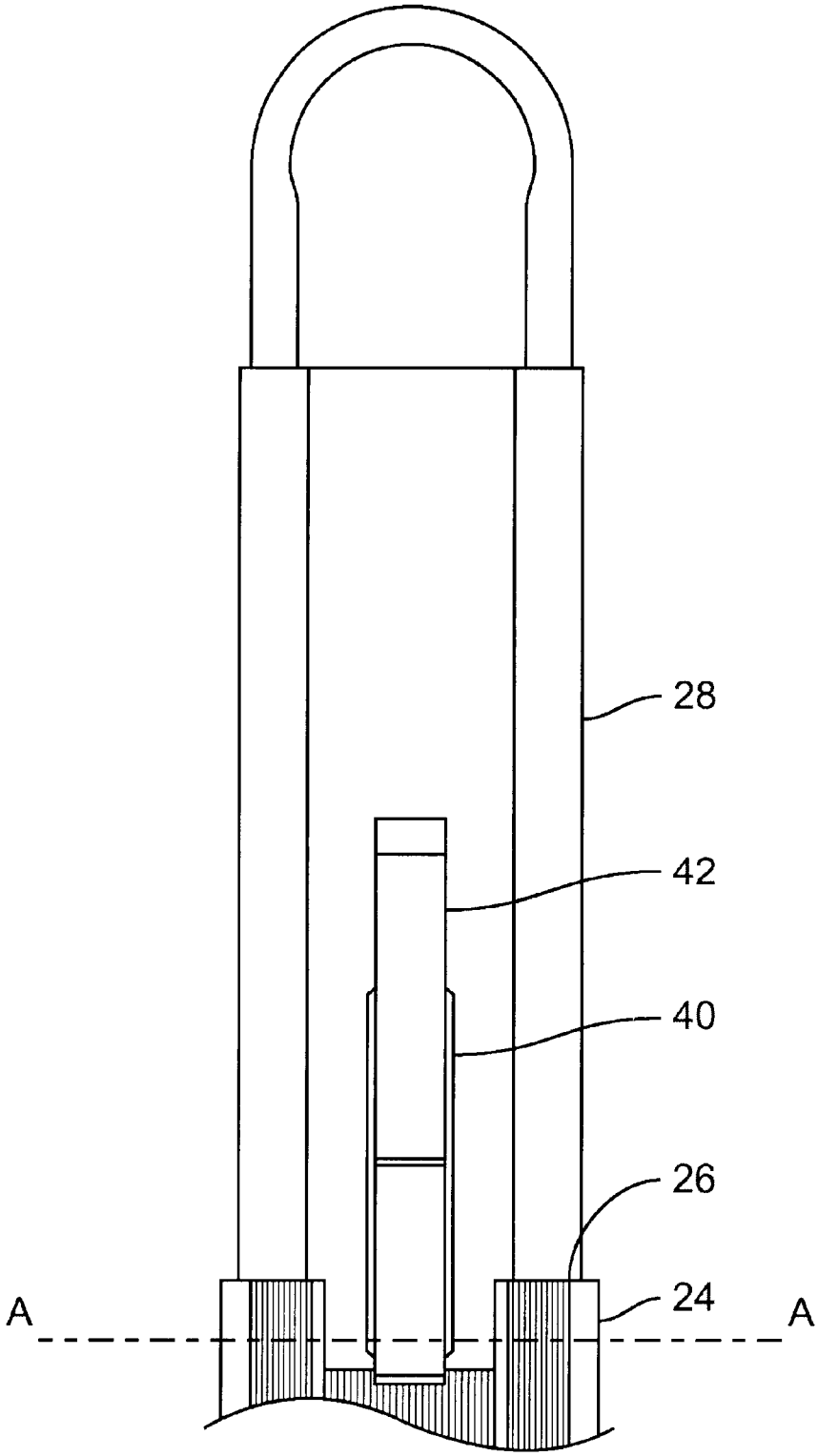
FIG. 5A is a side view of an alternative embodiment of the rail extension assembly, in which an elongated member has a notched section positioned at the top of the elongated member.

In an another embodiment, shown in FIG. 5A, the elongated member 24 (or in the alternative embodiment of FIG. 9 with the plate) has a notched section positioned at the top of the elongated member so that when the rail extension 28 and latch mechanism 42 are in the latched position, the depth of the notch and the position of the latch mechanism determine the height that the handle 36 extends above the top step of the ladder 10.

Figure 6:
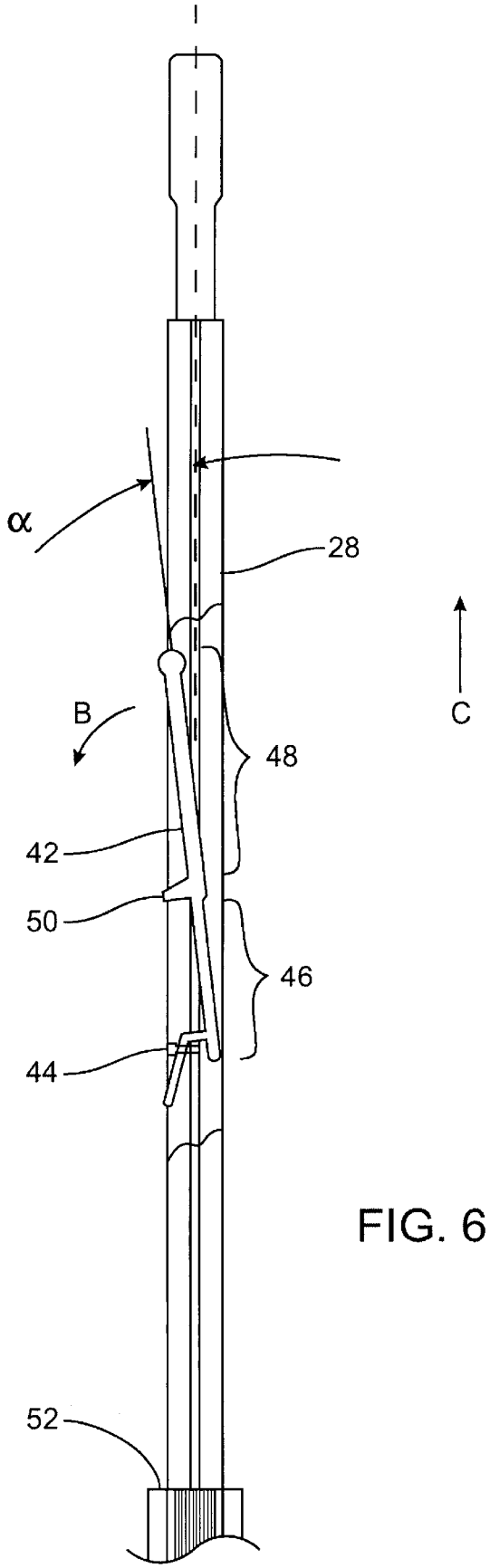
FIG. 6 is a front view of a rail extension in a lifted position and the latch mechanism is in an unlatched position.

FIG. 6 illustrates the rail extension 28 moved from the retracted position of FIG. 3 in an upward or first direction of arrow C, to a lifted position with the latch mechanism 42 in the unlatched position. The latch mechanism 42 is coupled to the rail extension 28 by the connecting means 44 such that the latch mechanism is at angle a from the longitudinal axis. The angle $\alpha$ can range between about 5 to 20 degrees.

In a preferred embodiment, the latch mechanism 42 has a narrow portion 46, a weighted portion 48, and a projecting member 50. The projecting member 50 is located between the narrow portion 46 and the weighted portion 48, which has a larger thickness than the narrow portion. The projecting member 50 extends from a surface of the latch mechanism 42 preferably by a distance of at least half of the thickness of a wall 52 of the elongated member 24.

Figure 7:
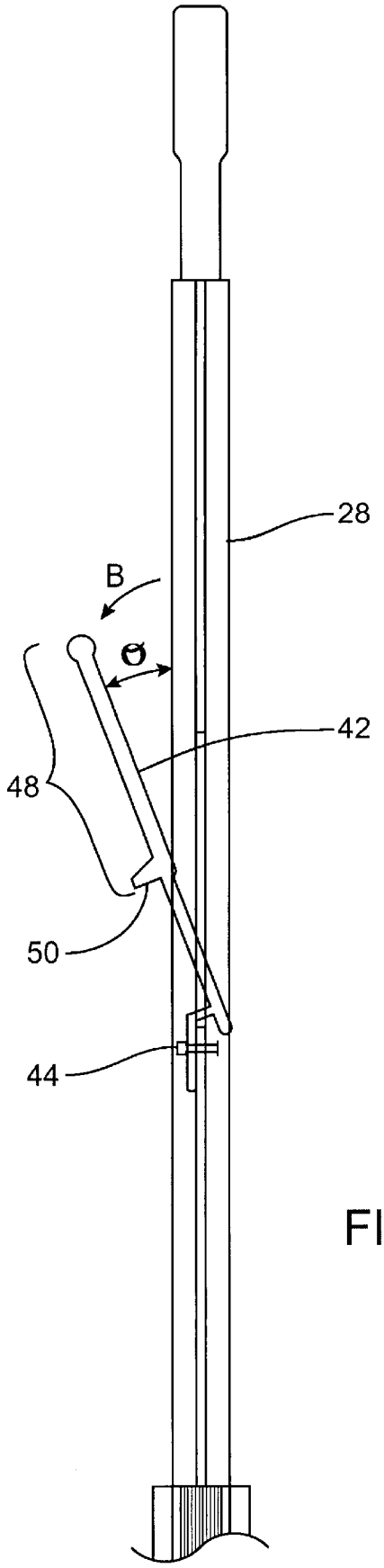
FIG. 7 is a front view of the rail extension of FIG. 6 and the latch mechanism is in a latched position.

As shown in FIG. 7, the weighted portion 48 is designed to move the latch mechanism 42, which pivotally rotates in the direction of arrow B through an angle $\theta$, relative to the longitudinal axis of the rail extension 28 to a latched position. As discussed, the latch mechanism 42 is in angled position so that when the rail extension is moved to the lifted position of FIG. 6, the weighted portion 48 will move the latch mechanism under the force of gravity. Specifically, when the latch mechanism 42 is no longer restrained by the elongated member 26, gravity forces the weighted portion 48 to pivotally move the latch mechanism from the unlatched position to a latched position, shown in FIG. 7.

Figure 8:
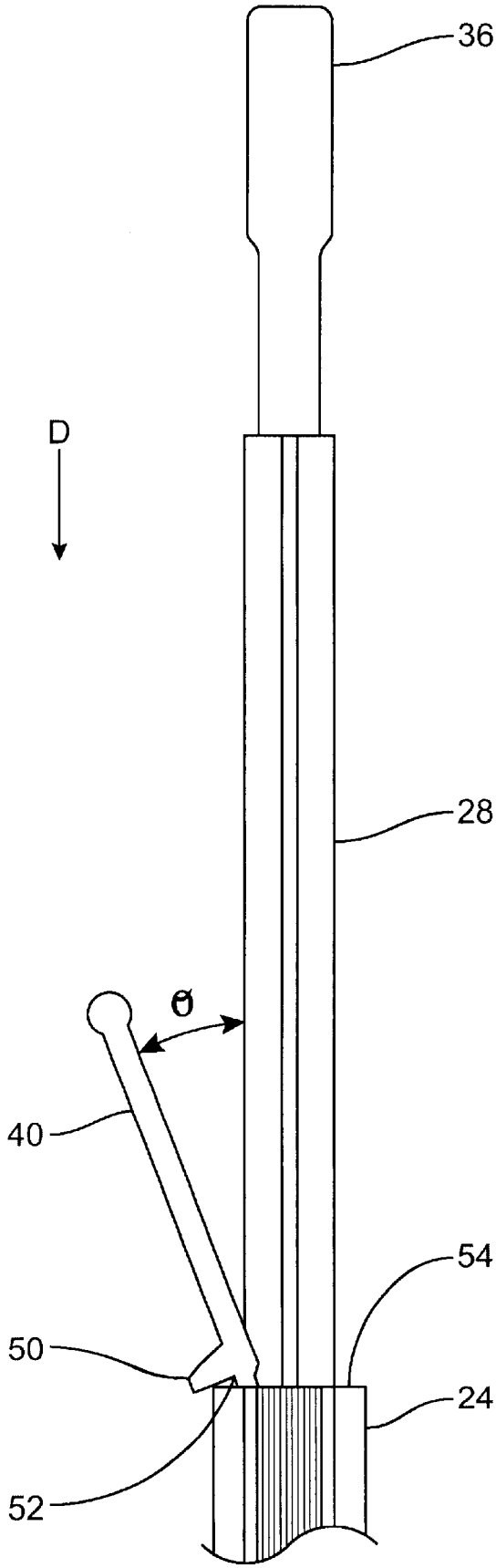
FIG. 8 is a front view of the rail extension of FIG. 6 and the latch mechanism is in a latched position, wherein the latch mechanism is supporting the rail extension.

As shown in FIG. 8, the rail extension 28 is then moved in a downward direction of arrow D from the lifted position to an extended and latched position. In the extended and latched position, the latch mechanism 42 pivots so that the projecting member 50 catches the wall 52 of the elongated member 24. When the projecting member 50 catches the wall 52 of the elongated member 24, the projecting member 50 supports the rail extension 28 at the extended position and prevents further insertion of the rail extension into the elongated member. The handle 36 will extend a predetermined distance of about 24 to 60 inches, preferably about 42 inches, beyond the end 54 of the elongated member 24. Accordingly, a user seeking to climb onto or descend from the roof using the lift up rail extension ladder 20 can easily locate a top step of the ladder by using the handle 36 which is positioned directly adjacent the top step.

As discussed above, the rail extension 28 includes two cylindrical members 160 connected by a web 162. The passage 26 of the elongated member 24 is of comparable size and cross section as the rail extension 28, and is also preferably made of a softer aluminum than the rail extension. In particular, the passage 26 will provide a clearance of about 0.010 to 0.125 inches from the rail extension 28. Preferably, the passage 26 will provide a clearance of about 0.040 inches.

Figure 9:
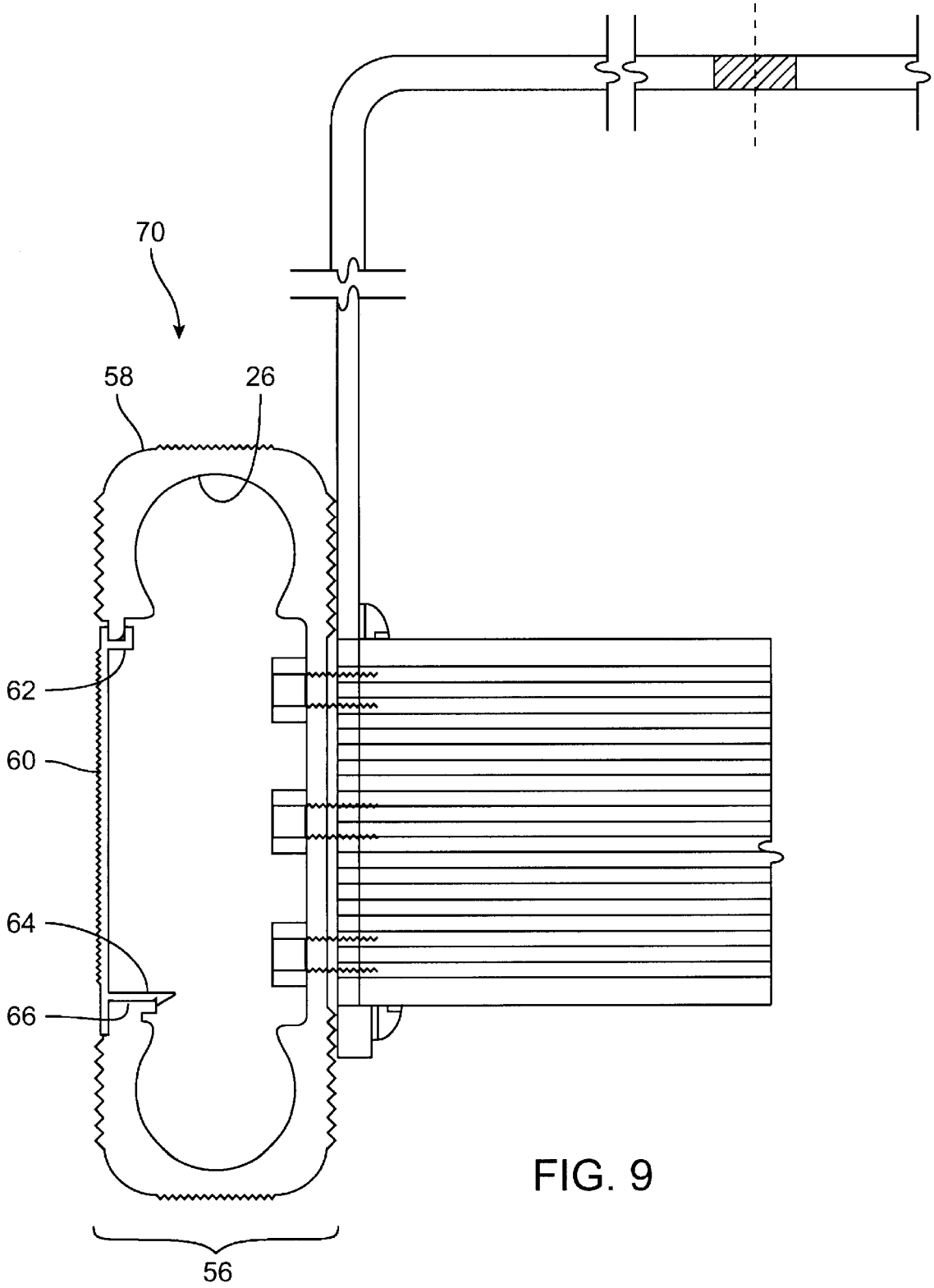
FIG. 9 is a partial top view of a lift up rail extension ladder.

According to an alternative embodiment, as illustrated in FIG. 9, the elongated member 56 is substantially similar to the embodiment of FIG. 3, except that the elongated member 24 includes a channel member 58 and a rigid plate 60. The plate 60 has a first mating member 62 and a second mating member 64. When mounting the plate 60 to the channel member 58, the second mating member 64 locates a side surface 66 of the channel member and guides the plate during the mounting process.

Figure 10:
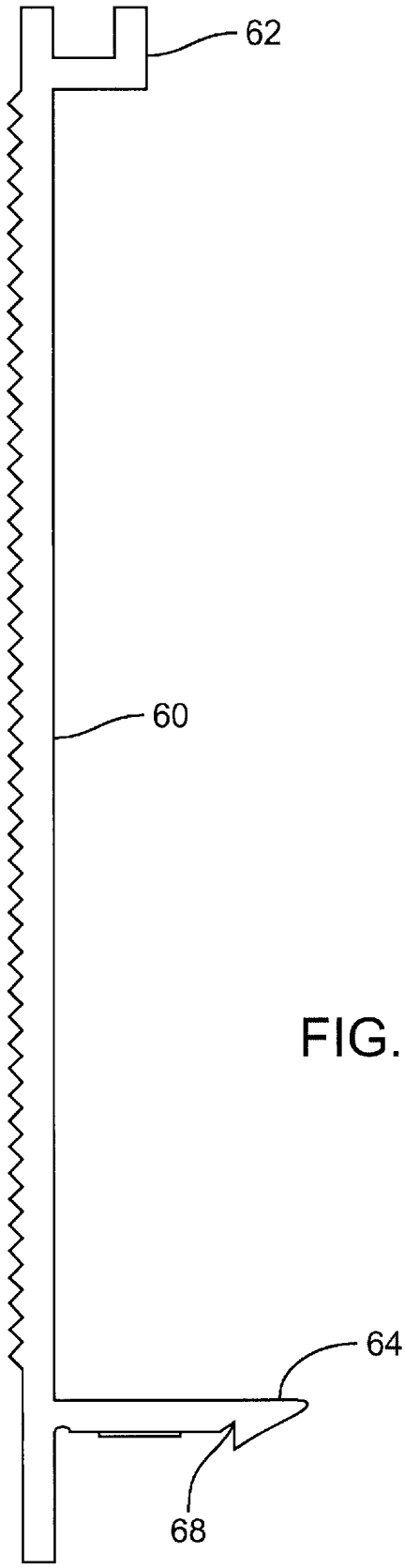
FIG. 10 is an enlarged top view of a plate.

As best shown in FIG. 10, the second mating member 64 has a groove 68 which also secures the plate 60 to the channel member 58.

Figure 11:
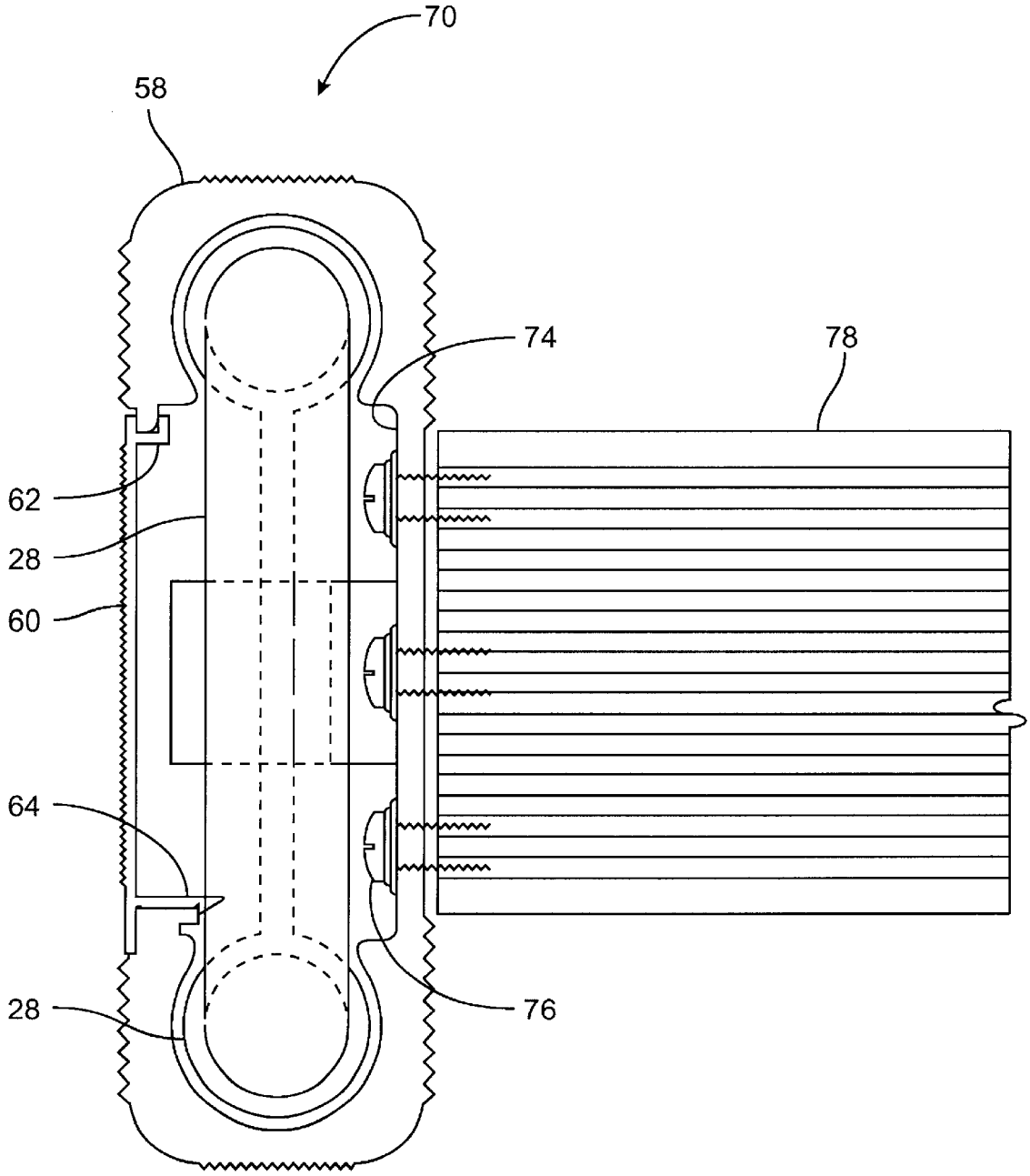
FIG. 11 is a partial enlarged top view of the lift up rail extension ladder of FIG. 9 with a rail extension inserted within the lift up rail extension ladder.

FIG. 11 shows the two mating members 62, 64 coupling with the channel member 58 so that the joined channel member and plate 60 form a tubular sleeve 70. This tubular sleeve 70 can slidably receive the rail extension 28. A stopping means 72 is mounted to an inner surface 74 of the channel member 58. The stopping means 72 supports the rail extension 28 in a first retracted position and prevents further insertion of said rail extension into the elongated member 56 beyond a predetermined distance. The plate 60 also covers or hides the fastening means 76 which attach a step member 78 to said elongated member 56, thereby enclosing the fasteners and providing enhanced aesthetic qualities.

Figure 15:
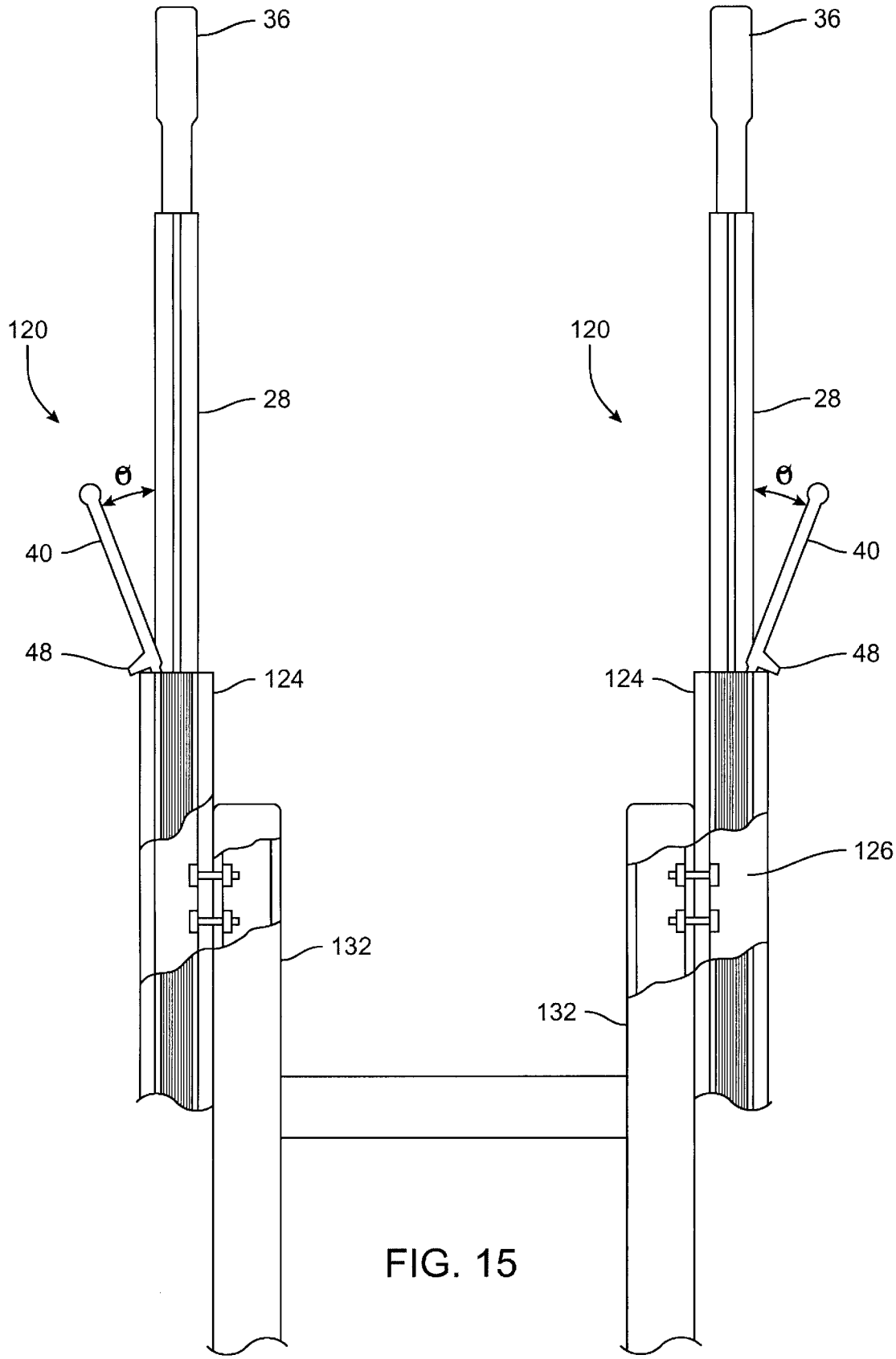
FIG. 15 is an alternative embodiment of the rail extension of the present invention, in which a shortened rail extension assembly without steps is mounted onto an existing ladder.

FIG. 15 illustrates another embodiment of the present invention, in which a rail extension ladder assembly 120, includes a pair of elongated members 124. The rail extension ladder assembly 120 differs from the previously described rail extension ladder assembly 20. For instance, the rail extension ladder assembly 120 does not include a step. Instead, the pair of elongated members 124 are connected to the legs 132 of a ladder by fastening means 126. As described above, each rail extension 28 is housed in elongated members 124, in a manner similar to the embodiment shown in FIG. 3. The elongated members 124 can be attached to the ladder 10 by using fastening means 126. Such fastening means may include any suitable means including, but not limited to, nuts and bolts, clamps, hooks, or straps. In this way, the rail extension ladder assembly 120 shown in FIG. 15 can be attached to a variety of different ladders.

Figure 12:
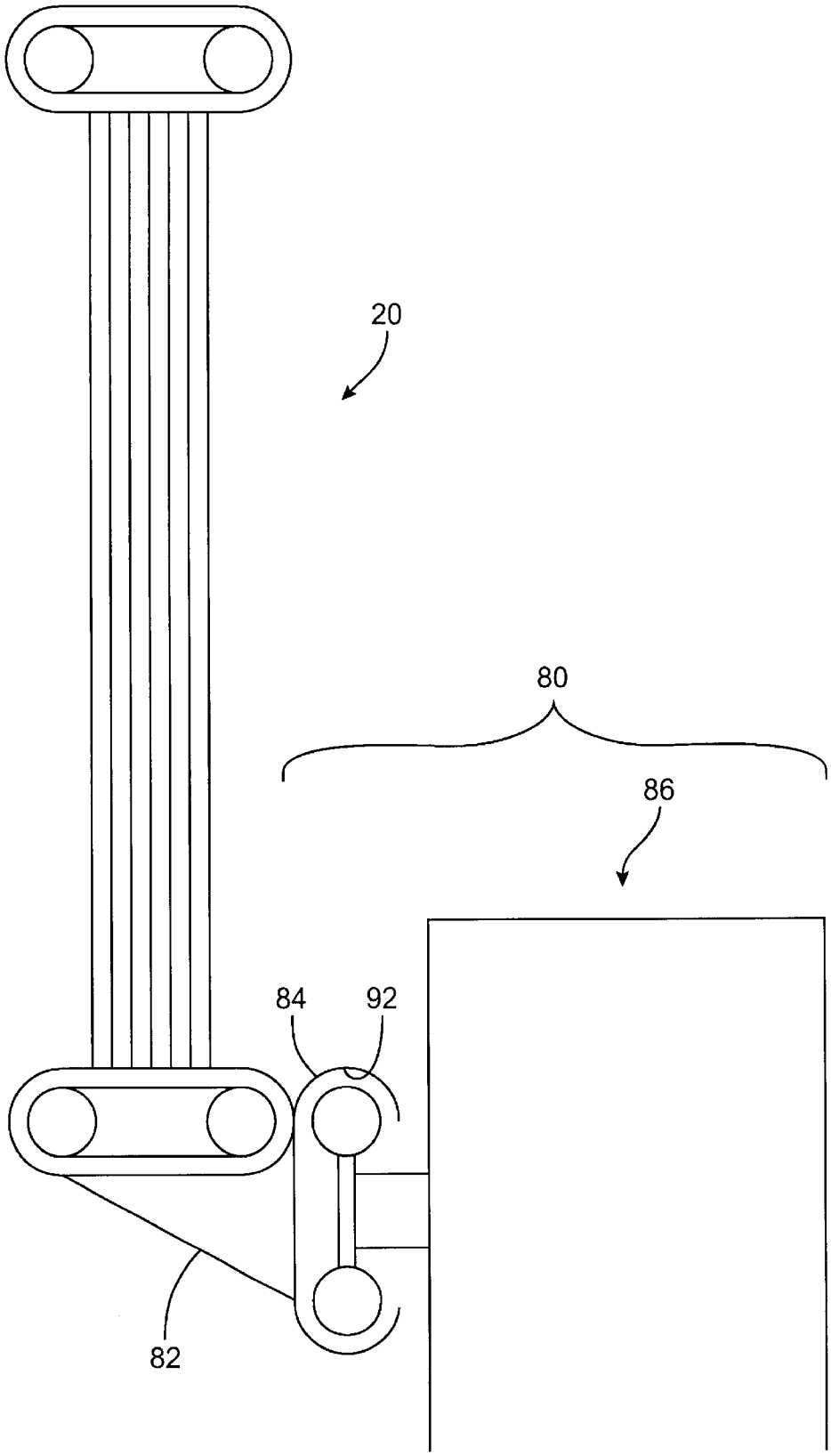
FIG. 12 is a top view of a lift up rail extension ladder and a tool lift assembly.

In yet another embodiment of the present invention, shown in FIG. 12, the lift up rail extension ladder 20 is used in cooperation with a tool lift 80. The tool lift 80 attaches to the lift up rail extension ladder 20 using a bracing device 82 which secures the tool lift to the lift up rail extension ladder. For example, the bracing device 82 may include an angled bracket that is welded or otherwise fastened to one of the elongated members.

Figure 13:
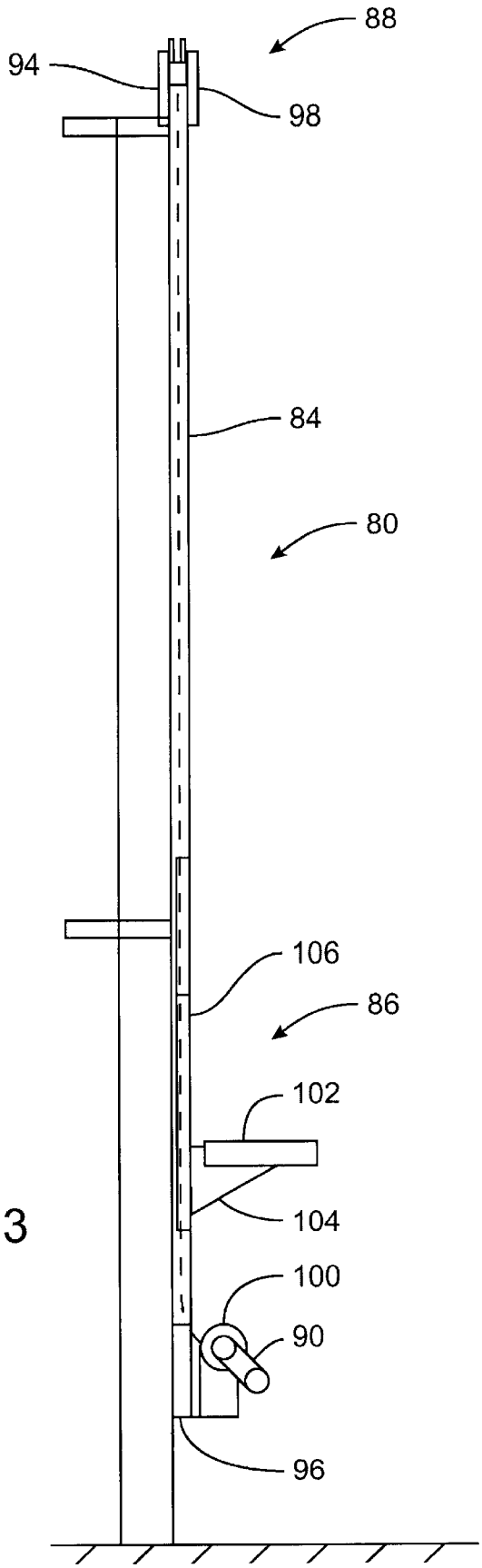
FIG. 13 is a side view of a tool lift assembly.

As shown in FIGS. 12 and 13, the tool lift 80 has an elongated channel 84, a lift platform or carriage 86, a cable and pulley arrangement 88, and a winch 90. The elongated channel 84 has a passage 92 (as best shown in FIG. 12) which extends from a top end 94 to a bottom end 96 of the elongated channel. The passage 92 is provided to allow the elongated channel 84 to slidably receive the lift platform 86. The pulley 98 of the cable and pulley arrangement 88 is mounted to the elongated channel 84 at the top end, and the winch 90, which has a winding drum 100. The winding drum 100 is secured to the elongated channel near the bottom end 96. The lift platform 86 includes a platform 102, a supporting member 104, and a mounting member 106. The mounting member 106 is similar to the rail extension in the embodiment shown in FIG. 3, except that there is no latching mechanism on the mounting member 106. In addition, the mounting member 106 is slidably mounted within the passage 92 of the elongated channel 84.

Figure 14:
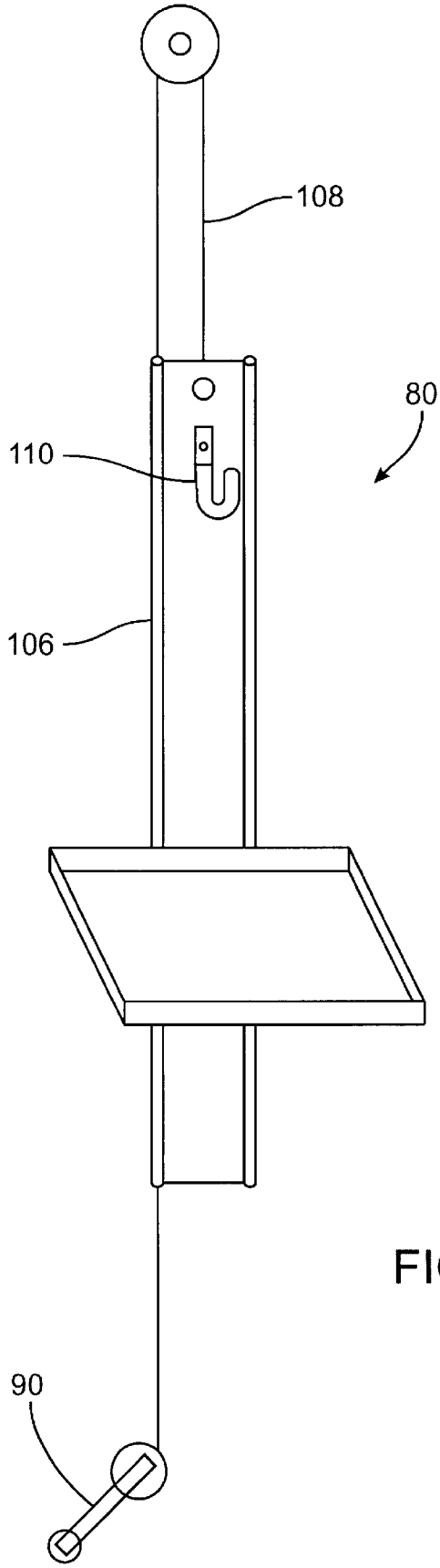
FIG. 14 is a perspective view of the tool lift assembly of FIG. 13 without an elongated member.

FIG. 14 illustrates a tool lift 80 without the elongated channel 84. The mounting member 106 is secured by a cable 108 of the cable and pulley arrangement and extends to the winch 90. The cable 108 extends through the mounting member 106 from the winch, around the pulley and terminates at a location that is centered at the top of the mounting member 106. The winch is a reversible rachet type winch that can be locked into position at any point of rotation. Therefore, when the tray is raised to the desired location, the winch is locked in position. A projecting member 110 extends from the mounting member 106 to provide a means for securing an item while using the tool lift 80 to lift that item. For example, the projecting member 110 may comprise a hook, clasp, or peg for securing a tool belt. Additionally, the platform 102 may have raised edges to form a tray.

In operation, by turning the winch, the cable and pulley arrangement 88 can move the lift platform 86 in a generally vertical direction between the top and bottom ends 94, 96 of the elongated channel 84 and locked into position. In an alternative embodiment, a reversible motor (not shown) can be attached to the winding drum 100 to facilitate the moving of the lift platform 86. Accordingly, the user can move materials, tools, and his person to a roof by using the tool lift and lift up rail extension ladder assembly 20.

Figure 16:
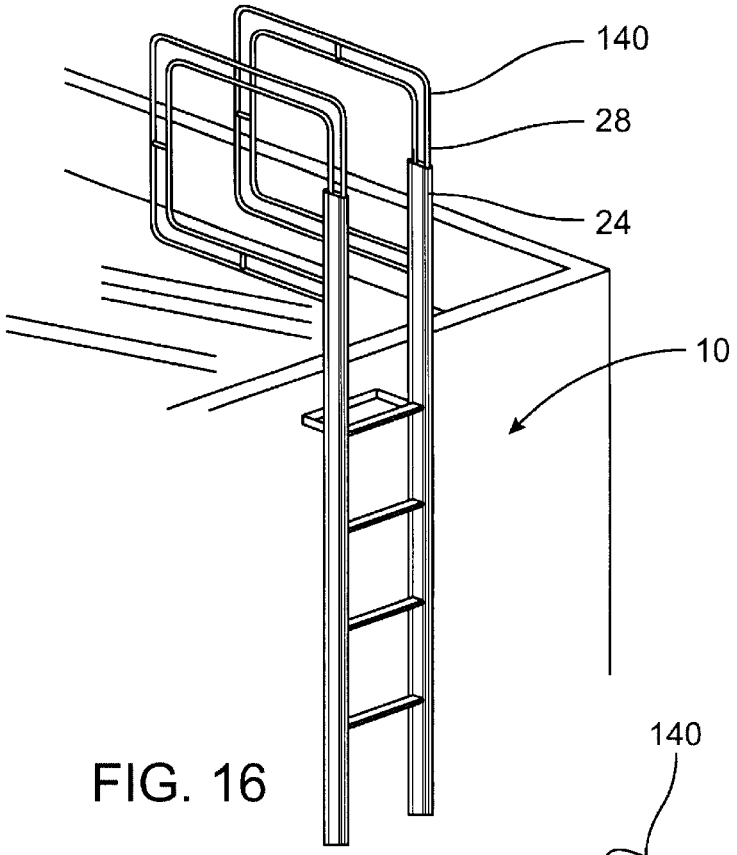
FIG. 16 is an alternative embodiment of the rail extension of the present invention, in which the handle is replaced with side rails.
Figure 17:
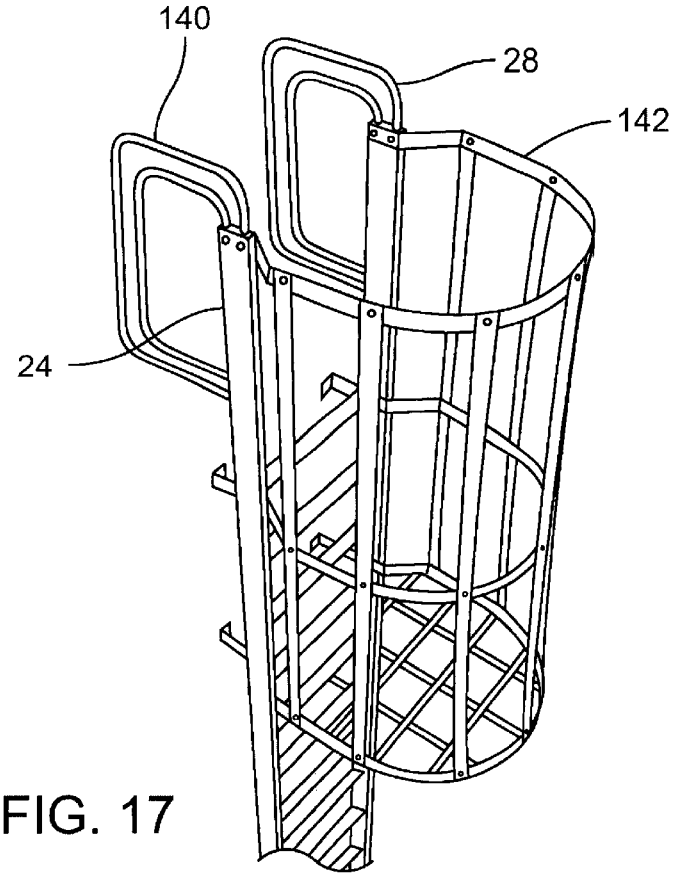
FIG. 17 is another alternative embodiment of the rail extension of the present invention, in which the ladder includes a cage.

FIGS. 16 and 17 illustrate two alternative embodiments of the present invention. The rail extensions 28 in FIGS. 16 and 17 include side rails 140 extending above the elongated member 24. In addition, FIG. 17 shows a ladder having a cage 142 attached thereon. FIGS. 16 and 17 are illustrative of the fact that the lift up rail extension ladder of the present invention is not limited with respect to the type of handle that can be mounted on top of the rail extension. Instead, it is evident that any type of suitable handle or side rail may be mounted thereon without deviating from the scope of the present invention.

While the invention has been described in detail with reference to the preferred embodiments thereof, it will be apparent to one skilled in the art that various changes and modifications can be made and equivalents employed without departing from the present invention.

What is claimed is:

1. A rail extension assembly for mounting onto an existing ladder, the existing ladder having a first rail and an opposite second rail, wherein said first and second rails are connected by at least one step, the rail extension assembly comprising:

a first rail extension movably mountable to the first rail of the existing ladder;

a second rail extension movably mountable to the second rail of the existing ladder and movable separately from the first rail extension;

a first means for latching said first rail extension onto said first rail, wherein said first means for latching is pivotally mounted on the first rail extension;

a second means for latching said second rail extension onto said second rail, wherein said second means for latching is pivotally mounted on the second rail extension; and said first and second means for latching each having an unlatched position and a latched position, wherein said first and second means for latching each have a weighted portion so that when the respective rail extension is extended in a first direction, a weight of the weighted portion moves the means for latching to said latched position.

2. The rail extension assembly according to claim 1, wherein the first and second rail extensions are slidably mountable to the first and second rails of the existing ladder.

3. The rail extension assembly according to claim 2, wherein the first and second rail extensions are movable in a first direction from a first retracted position to a second extended position.

4. The rail extension assembly according to claim 3, wherein the first and second rail extensions are extendable a predetermined distance with respect to the first and second rails of the existing ladder when said first and second rail extensions are at the second extended position.

5. The rail extension assembly according to claim 3, wherein the first and second means for latching prevent the first and second rail extensions from moving in a second direction opposite the first direction when said first and second means for latching are in the latched position.

6. The rail extension assembly according to claim 5, wherein, in the latched position, the first and second means for latching support the first and second rail extensions and are supportable by the first and second rails of the existing ladder.

7. The rail extension assembly according to claim 3, further comprising stop means for limiting sliding movement of the first and second rail extensions and so that the stop means supports the first and second rail extensions at the first retracted position.

8. The rail extension assembly according to claim 7, further comprising a first handle mounted on said first rail extension and a second handle mounted on the second rail extension.

9. The rail extension assembly according to claim 8, wherein the first and second handles are extendable beyond the first and second rails of the existing ladder when said first and second rail extensions are at the first retracted position.

10. The rail extension assembly according to claim 1, wherein the first and second rail extensions include locating means for locating a top step of the existing ladder.

11. The rail extension assembly according to claim 1, wherein the weighted portion moves the means for latching to the latched position due to gravity.

12. The rail extension assembly according to claim 1, further comprising a first elongated hollow member for receiving the first rail extension and a second elongated hollow member for receiving the second rail extension.

13. The rail extension assembly according to claim 12, wherein the first and second elongated hollow members are attachable to a ladder stile.

14. The rail extension assembly according to claim 1, wherein the first and second means for latching are movable to said latched position by a weight of the weighted portion without the use of a spring.

15. A ladder assembly comprising:

a first and a second elongated hollow member;

at least one step member horizontally mounted between the first and second elongated hollow members;

a first rail extension being slidably mounted within the first elongated hollow member;

a second rail extension being slidably mounted within the second elongated hollow member and movable separately from the first rail extension;

a first means for latching said first rail extension onto said first rail, wherein said means for latching is pivotally mounted to the first rail extension, the first means for latching having an unlatched position and a latched position; and a second means for latching said second rail extension onto said second rail, wherein said second means for latching is pivotally mounted to the second rail extension, the second means for latching having an unlatched position and a latched position; and wherein said first and second means for latching each have a weighted portion so that when each said rail extension is extended in a first direction, a weight of the weighted portion moves each said means for latching to said latched position.

16. The ladder assembly according to claim 15, wherein the first and second rail extensions provide locating means for locating a top step of said ladder assembly.

17. The ladder assembly according to claim 16, further comprising means for securing the ladder assembly to a wall.

18. The ladder assembly according to claim 17, wherein said means for securing the ladder assembly to the wall includes a bracket member and fastening means.

19. The ladder assembly according to claim 18, wherein the first and second rail extensions move in a first direction from a first retracted position to a second extended position.

20. The ladder assembly according to claim 19, wherein the first and second rail extensions extend a predetermined distance with respect to the first and second elongated hollow members when said first and second rail extensions are at the second extended position.

21. The ladder assembly according to claim 20, wherein the first and second means for latching prevent the first and second rail extensions from moving in a second direction opposite the first direction when said first and second means for latching are in the latched position.

22. The ladder assembly according to claim 21, wherein, in the latched position, the first and second means for latching support the first and second rail extensions and are supported by the first and second elongated hollow members of said ladder assembly.

23. The ladder assembly according to claim 15, wherein the weighted portion moves the means for latching to the latched position due to gravity.

24. The ladder assembly according to claim 15, comprising a tool lift assembly comprising a lift platform coupled with a third elongated hollow member, a cable and a pulley, and a winch secured to an elongated hollow member, the winch having means for moving the lift platform with said cable and said pulley along said third elongated hollow member.

25. The ladder assembly of claim 24, wherein the cable includes a cable having means for securing attached to the lift platform.

26. The ladder assembly of claim 25, wherein attaching means secures the tool lift assembly to the ladder assembly.

27. The ladder assembly of claim 26, wherein the means for moving the lift platform is a means for power operating.

28. The ladder assembly according to claim 15, wherein the first and second means for latching are movable to said latched position by a weight of the weighted portion without the use of a spring.

29. A method of providing assistance in descending from or climbing onto an existing ladder having a lift up rail extension, the existing ladder having a first rail and an opposite second rail, wherein said first and second rails are connected by at least one step, the method comprising the steps of:

extending a first rail extension slidably mounted to the first rail of the existing ladder in a first direction;

extending a second rail extension slidably mounted to a second rail of an existing ladder in the first direction and movable separately from the first rail extension, wherein a first and a second means for latching pivotally mounted to the first and second rail extensions have an unlatched position and a latched position, said first and second means for latching each having a weighted portion; and allowing a weight of the first and second weighted portions to move the first and second means for latching to said latched position, wherein the first and second rail extensions provide locating means for locating a top step of said existing ladder.

30. The method according to claim 29, wherein the first and second means for latching are movable to said latched position by a weight of the first and second weighted portions without the use of a spring.

31. A ladder assembly comprising:

a first and a second elongate member;

at least one step member mounted between the first and second elongate members;

a first rail extension slidably mounted on the first elongate member and movable from a retracted position to an extended position;

a first means for latching said first rail extension to said first rail at the extended position, the first means for latching pivotally mounted on the first rail extension and pivotable to latch to the first rail by a weight of the means for latching;

a second rail extension slidably mounted on the second elongate member and movable from a retracted position to an extended position independently of the first rail extension; and a second means for latching said second rail extension to said second rail at the extended position, the second means for latching pivotally mounted on the second rail extension and pivotable to latch to the second rail by a weight of the means for latching.

32. The ladder according to claim 31, wherein the first and second means for latching are movable to a latched position by a weight of a weighted portion of the first and second means for latching without the use of a spring.

* * * * *